US008231293B2

(12) United States Patent
Huang

(10) Patent No.: US 8,231,293 B2
(45) Date of Patent: Jul. 31, 2012

(54) CLEANING PEN

(75) Inventor: Kuan-Di Huang, Sanchong (TW)

(73) Assignees: Kuan-Di Huang, Taipei County (TW); Su-Shun Chen, Taipei County (TW)

( * ) Notice: Subject to any disclaimer, the term of this patent is extended or adjusted under 35 U.S.C. 154(b) by 157 days.

(21) Appl. No.: 12/805,360

(22) Filed: Jul. 27, 2010

(65) Prior Publication Data

US 2012/0027501 A1 Feb. 2, 2012

(51) Int. Cl.
*A47L 13/12* (2006.01)

(52) U.S. Cl. ..... 401/27; 401/25

(58) Field of Classification Search ..... 401/25, 401/27, 139, 199, 202
See application file for complete search history.

(56) References Cited

U.S. PATENT DOCUMENTS 2,770,826 A * 11/1956 Curfman ..... 401/139
3,749,502 A * 7/1973 Kreihe ..... 401/27

* cited by examiner

*Primary Examiner* — Tuan N Nguyen
(74) *Attorney, Agent, or Firm* — Bacon & Thomas, PLLC

(57) ABSTRACT

The present invention is to provide a cleaning pen, which includes a hollow clamping device having two clamping units able to be engaged with each other for clamping a wiping element in a bent state and being inserted into a hollow housing such that a bent portion of the wiping element juts out of the hollow housing and can be used for cleaning an object. When the bent portion is soiled or damaged, a user can conveniently and sequentially take the wiping element out from the hollow housing and hollow clamping device, and then shift the soiled or damaged portion to a position for allowing the wiping element to be clamped by the hollow clamping device again and form a new bent portion jutting out of the hollow housing, so as to effectively prevent the object from being scratched by edge of the wiping element and prolong service life thereof.

10 Claims, 3 Drawing Sheets

CLEANING PEN

FIELD OF THE INVENTION

The present invention relates to a cleaning pen, more particularly to a cleaning pen including a hollow clamping device and a wiping element, wherein the hollow clamping device consists of two clamping units which can be engaged with each other to form a single piece for clamping the wiping element in a bent state and allowing a bent portion of the wiping element to jut out of the cleaning pen and be used for cleaning an object, so as to effectively prevent the object from being scratched by edge of the wiping element and prolong service life of the wiping element.

BACKGROUND OF THE INVENTION

Nowadays, cell phones, digital cameras, and like digital products are generally equipped with display screens and lenses. However, as the display screens and the lenses are exposed on the outside of such digital products, they are likely to be soiled by airborne dust, which prevents users from viewing or capturing clear images with these digital products.

Conventionally, a wiping cloth is used to wipe off the grease, dust, etc. on the display screens or the lenses, and yet the cleaning effect of the wiping cloth is limited by the shape of the users' fingers, for it is impossible to insert a human finger into the small corners or recessed edges of the display screens and the lenses. As a result, the cleaning tends to be incomplete, and the grime remaining on the display screens and the lenses not only continues to compromise the quality of the images displayed or captured, but also keeps accumulating and hardening. When the display screens and the lenses are subsequently wiped again, the hardened grime may abrade their surfaces and leave permanent scratches thereon.

As a solution to the aforesaid problem, a cleaning pen has been developed, as shown in FIG. 1. The cleaning pen 1 has a columnar holding portion 10, which is protrudingly provided with an extended seat 11 at one end. The extended seat 11 has an end surface facing away from the holding portion 10 and provided with a wiping cloth 12 having a carbon coating. When the cleaning pen 1 is used to clean a lens, the wiping cloth 12 with the carbon coating can reach into the corners or recessed edges of the lens by virtue of the extended seat 11 so as to clean the lens thoroughly, thereby allowing users to once again view or capture clear images with the digital product mounted with the lens.

Nevertheless, market surveys have shown that the cleaning pen 1 has the following two major drawbacks in use:

1. Due to the properties of the materials, the wiping cloth 12 with the carbon coating is not suitable for cleaning display screens. Therefore, a user wishing to clean a display screen with the cleaning pen 1 has to buy another cleaning pen designed specifically for cleaning display screens, which is inconvenient.

2. As the wiping cloth 12 of the cleaning pen 1 wipes off the grime on a lens, the grime adheres to the wiping cloth 12. Moreover, the grime accumulated on the wiping cloth 12 increases with the number of use of the wiping cloth 12. Since the wiping cloth 12 of the cleaning pen 1 cannot be replaced directly, the user has no choice but to buy a new cleaning pen 1 when a certain amount of grime has accumulated on the wiping cloth 12, thereby preventing the grime on the wiping cloth 12 from falling on, attaching to, or even scratching the lens.

Now that the service life of the cleaning pen 1 cannot be effectively extended, new cleaning pens 1 must be bought on a regular basis. Besides, the risk of scratching is always present when using the cleaning pen 1 to clean a lens. Furthermore, as stated above, the carbon coated wiping cloth 12 is not suitable for cleaning display screens. In short, the cleaning pen 1 is still inconvenient to use and may cause trouble to its users.

Therefore, the present invention is intended to overcome the drawbacks of the foregoing cleaning pen while providing means of effectively cleaning display screens as well as lenses.

BRIEF SUMMARY OF THE INVENTION

In view of the above, the inventor of the present invention has developed a novel cleaning pen as disclosed herein whose service life, unlike that of the conventional cleaning pen, is effectively extended, whose cleaning effect on an object to be cleaned (e.g., a display screen, a lens, etc.) is enhanced, and which is prevented from scratching the object being cleaned.

It is an object of the present invention to provide a cleaning pen which includes a hollow clamping device, a wiping element, and a hollow housing. The hollow clamping device consists, of two clamping units which can be engaged with each other to form a single piece for clamping the wiping element in a bent state and allowing a bent portion of the wiping element to jut out of the hollow clamping device. The hollow clamping device can be inserted into and fixed in position in the hollow housing such that the bent portion of the wiping element juts out of the hollow housing. The bent portion of the wiping element is wetted by a cleaning liquid and then used to clean an object. When the wiping element is soiled or damaged, it can be conveniently and sequentially taken out from the hollow housing and the hollow clamping device and be bent again, thereby shifting the soiled or damaged portion of the wiping element to a position where it is clamped by the hollow clamping device and allowing a clean portion of the wiping element to jut out of the hollow clamping device. After the cleaning pen is reassembled, a clean bent portion of the wiping element can be used for cleaning. Thus, not only is a thorough cleaning effect achievable, but also the grime attached to the wiping element is prevented from scratching the object being cleaned. Moreover, the service life of the wiping element is effectively increased.

It is another object of the present invention to provide the foregoing cleaning pen, wherein the other end of the hollow housing is provided with a receiving cavity for containing the cleaning liquid, and the cleaning pen further includes a nozzle head covering and fixed in position to the receiving cavity. A user wishing to clean an object with the cleaning pen can direct the nozzle of the nozzle head toward the object and press the nozzle head such that the nozzle head draws the cleaning liquid in the receiving cavity and sprays the cleaning liquid on the object. Then, the user can wet the wiping element conveniently with the cleaning liquid on the object and clean the object thoroughly.

It is yet another object of the present invention to provide the foregoing cleaning pen, wherein the hollow housing is provided with a cleaning brush at the end opposite the hollow clamping device. Thus, a user can brush dust or dirt particles off the surface of an object to be cleaned before cleaning the object with the wiping element, for if the object is directly wiped, with the dust or dirt particles still attached thereto, the object is very likely to be scratched by the wiping action.

It is a further object of the present invention to provide the foregoing cleaning pen, wherein a retracting seat is movably provided in the hollow housing and has an end provided with a cleaning brush. By moving the retracting seat, the cleaning brush is extended out of the hollow housing or is received therein.

BRIEF DESCRIPTION OF THE SEVERAL VIEWS OF THE DRAWINGS

The invention as well as a preferred mode of use, further objects, and advantages thereof will be best understood by referring to the following detailed description of some illustrative embodiments in conjunction with the accompanying drawings, in which.

DETAILED DESCRIPTION OF THE INVENTION

Figure 1:
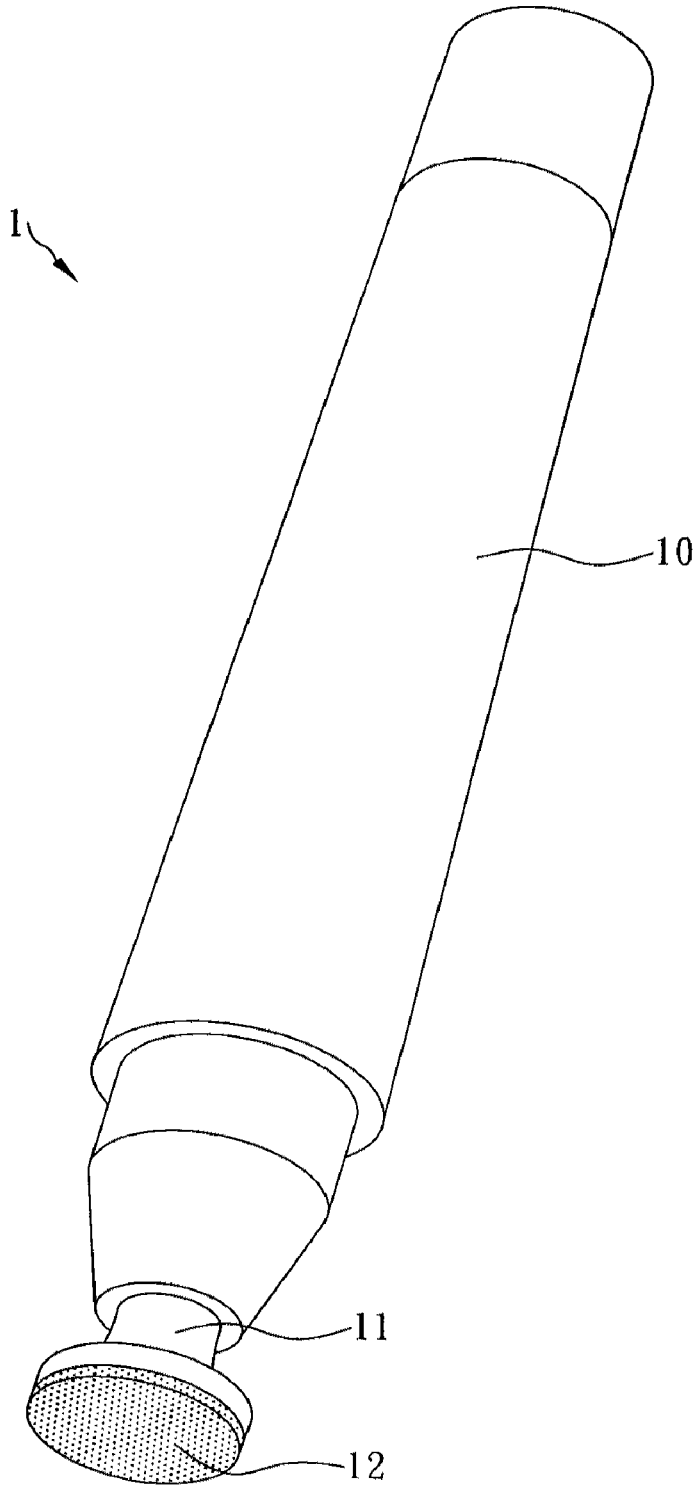
FIG. 1 (Prior Art)
FIG. 1 is a perspective view of a conventional cleaning pen.
Figure 2:
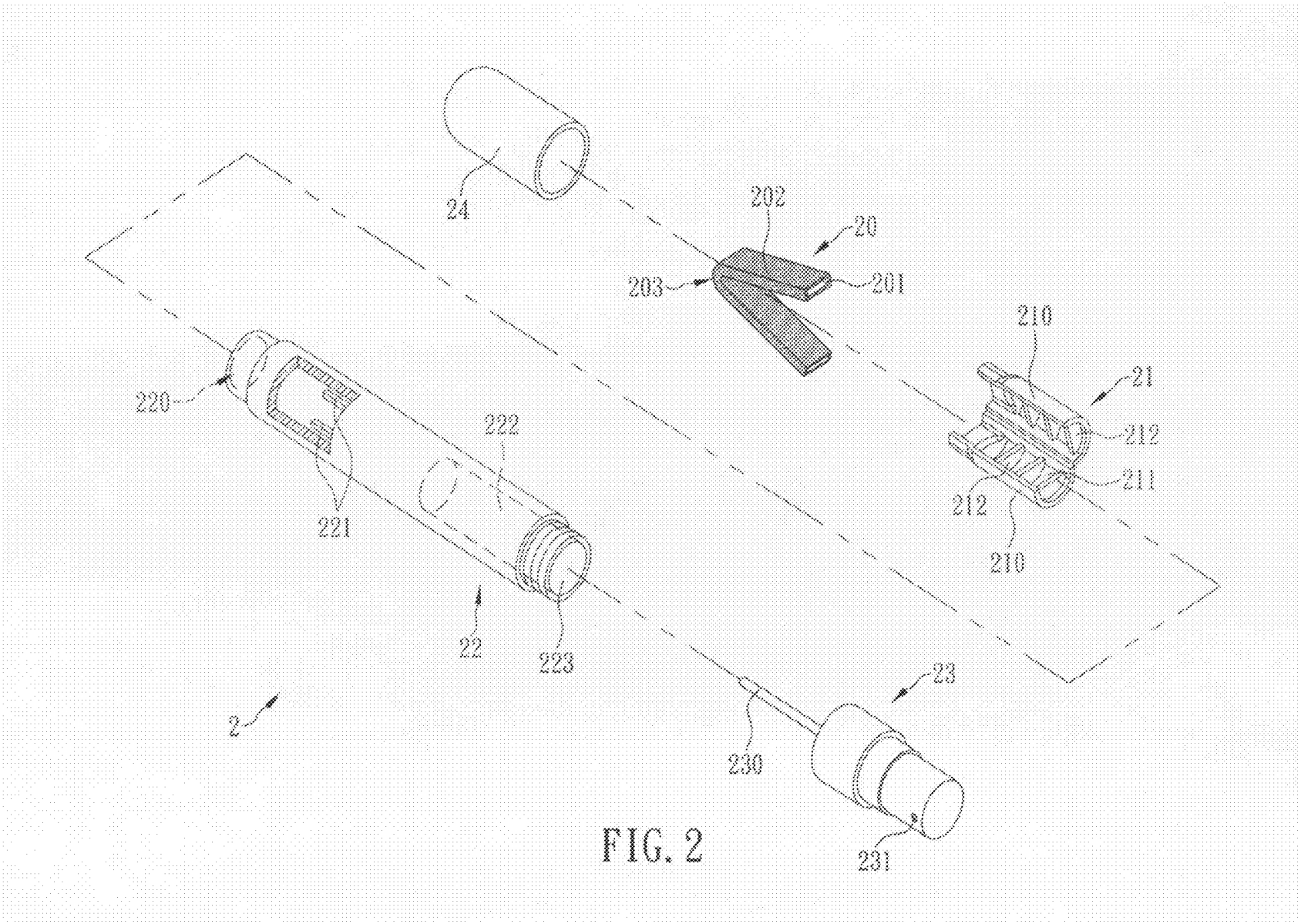
FIG. 2 is an exploded perspective view of a cleaning pen according to a, preferred embodiment of the present invention.

The present invention relates to a cleaning pen. A preferred embodiment of the present invention is shown in FIG. 2, wherein a cleaning pen 2 includes a wiping element 20, a hollow clamping device 21, and a hollow housing 22. The wiping element 20 is made of an absorbent material 201, coated with a wiping layer 202, and shaped as a strip. The absorbent material 201 is a material (e.g., a sponge, a foamed material, etc.) that is capable of absorbing liquid (e.g., water, a cleaning liquid, etc.). The wiping layer 202 is made of a fabric (e.g., nanofiber cloth, flannelette, felt, etc.) and serves to increase the structural strength of the wiping element 20 as well as the softness and fineness of the surface of the wiping element 20. The hollow clamping device 21 consists of two clamping units 210. The two clamping units 210 can be engaged with each other to form a single piece and define a clamping space 211 therebetween. The wiping element 20, when bent, can be fixedly clamped in the clamping space 211 such that a bent portion 203 of the wiping element 20 protrudes from the hollow clamping device 21. The hollow housing 22 has an opening 220 at a first end. The inner diameter of the opening 220 matches the outer diameter of the hollow clamping device 21, thus allowing the hollow clamping device 21 to be inserted into the hollow housing 22 through the opening 220 and be secured in position in the hollow housing 22. At least one stop unit 221 is protrudingly provided on the inner wall of the hollow housing 22 and adjacent to the opening 220 such that the hollow clamping device 21, when inserted in the hollow housing 22, is stopped at a predetermined position in the hollow housing 22 while the bent portion 203 of the wiping element 20 protrudes from the hollow housing 22.

A user can wet the bent portion 203 of the wiping element 20 with a cleaning liquid such that the cleaning liquid penetrates the wiping layer 202 evenly and is absorbed by the absorbent material 201. The user can then hold the hollow housing 22 and use the soft and fine surface of the bent portion 203 of the wiping element 20 to clean an object (e.g., a display screen, a lens, etc.). Once the wiping layer 202 of the wiping element 20 is soiled or damaged, the hollow clamping device 21 can be easily removed from the first end of the hollow housing 22, and the clamping units 210 disengaged from each other, so as to take out the wiping element 20 for adjustment. For instance, the bent portion 203 of the wiping element 20 is adjusted by bending the wiping element 20 again such that the soiled or damaged portion of the wiping layer 202 is moved to a position to be fixedly clamped by the clamping units 210 while a clean portion of the wiping layer 202 protrudes from the hollow clamping device 21. After the wiping element 20, the hollow clamping device 21, and the hollow housing 22 are sequentially put together, the now clean bent portion 203 of the wiping element 20 is ready to be used for cleaning. Thus, a thorough cleaning effect is ensured, the object to be cleaned is prevented from being scratched by the grime on the wiping layer 202, and the service life of the wiping element 20 is also effectively extended.

Referring to FIG. 2, in the present embodiment, a second end of the hollow housing 22 is provided with a receiving cavity 222 for holding the cleaning liquid. The cleaning pen 2 further includes a nozzle head 23. A drawing unit 230 is provided at a first end of the nozzle head 23 while a nozzle 231 is provided at one side of the nozzle head 23. The nozzle 231 is in communication with the drawing unit 230. The first end of the nozzle head 23 covers and is fixed in position to a cavity opening 223 of the receiving cavity 222 such that the drawing unit 230 is received in the receiving cavity 222 and ready to draw the cleaning liquid. When a second end of the nozzle head 23 is pressed, the cleaning liquid is drawn by the drawing unit 230 and sprayed out through the nozzle 231. Therefore, a user wishing to clean an object with the cleaning pen 2 can direct the nozzle 231 toward the object and press the second end of the nozzle head 23, thereby spraying the cleaning liquid on the object. Then, the user can wet the wiping element 20 at the first end of the hollow housing 22 with the cleaning liquid on the object and clean the object thoroughly with the wiping element 20.

Figure 3:
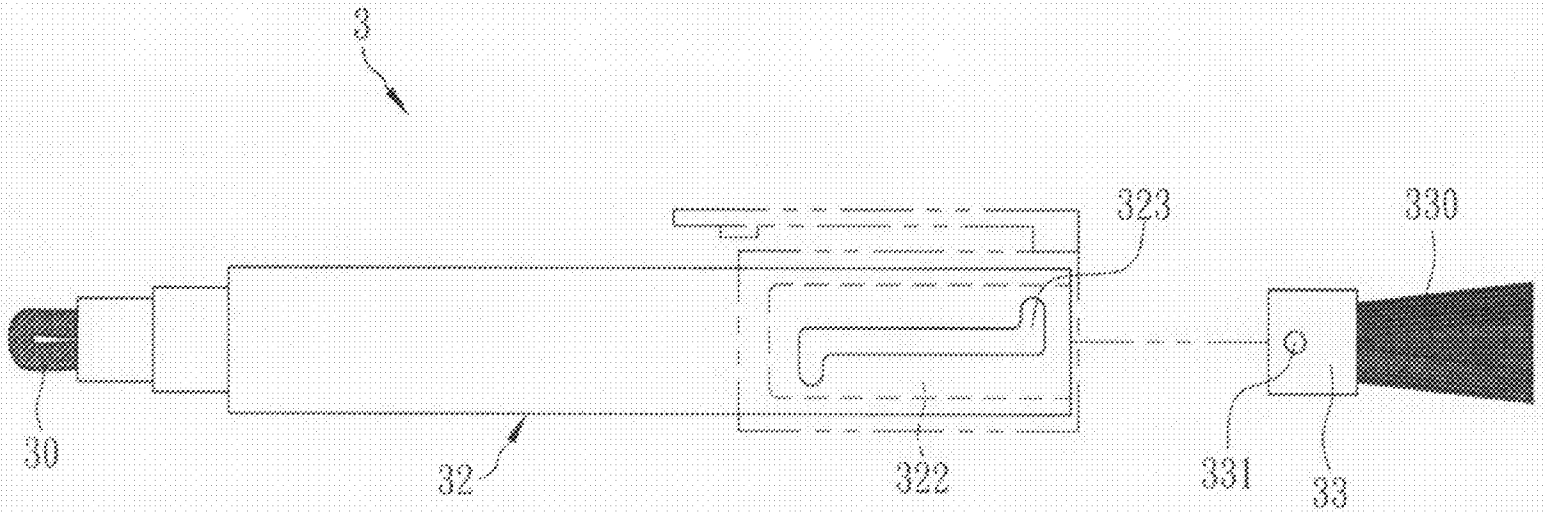
FIG. 3 is a side view of a cleaning pen according to another preferred embodiment of the present invention.

FIG. 3 shows another preferred embodiment of the present invention, wherein the cleaning pen 3 further includes a retracting seat 33. The retracting seat 33 is provided with a cleaning brush 330 at one end and is laterally provided with at least one projection 331. The retracting seat 33 is received in the receiving cavity 322 at the second end of the hollow housing 32 such that the projections 331 are respectively and movably received in a plurality of tracks 323 laterally provided on the wall of the receiving cavity 322. The cleaning brush 330 is received in the receiving cavity 322 when the retracting seat 33 is moved inward of the receiving cavity 322, and protrudes from the second end of the hollow housing 32 when the retracting seat 33 is moved outward of the receiving cavity 322. A user wishing to clean an object with the cleaning pen 3 can push the retracting seat 33 outward to expose the cleaning brush 330 from the hollow housing 32 and then use the cleaning brush 330 to brush off the dust or dirt particles on the surface of the object, before cleaning the object with the wiping element 30. Thus, the surface of the object is effectively protected from scratch which may otherwise result from the dust or dirt particles accumulated on the object or caught in the wiping element 30 if the object is directly wiped without being brushed first. Once the cleaning process is done, the retracting seat 33 can be pushed in the opposite direction to store the cleaning brush 330 in the receiving cavity 322 and thereby prevent the bristles of the cleaning brush 330 from splitting, deforming, or breaking, which may otherwise occur if the cleaning brush 330 is left exposed. By storing the cleaning brush 330 in the receiving cavity 322, the service life of the cleaning pen 3 is effectively increased.

Referring again to FIG. 3, while the cleaning brush 330 of the cleaning pen 3 in the present embodiment is installed on the retracting seat 33 as described above, installation of the cleaning brush 330 is not limited to the mode disclosed and may vary according to practical needs. For instance, it is feasible to install the cleaning brush 330 directly at the second end of the hollow housing 32, thus allowing manufacturers to cut the costs of making the retracting seat 33 and forming the tracks 323 on the hollow housing 32, provided that the cleaning effect of the cleaning pen 3 is ensured.

Besides, in the foregoing embodiments, with reference to FIG. 2, the inner wall of each clamping unit 210 is protrudingly provided with at least one anti-slip rib 212. Thus, the bent wiping element 20, when clamped by the clamping units 210, is secured in position by the anti-slip ribs 212. In particular, when the wiping element 20 is used to wipe an object, the anti-slip ribs 212 prevent the wiping element 20 from being pushed back into the clamping space 211 and thereby enable effective use of the wiping element 20 in cleaning.

Moreover, in the foregoing embodiments, with reference to FIG. 2, the cleaning pen 2 further includes a cap 24. The cap 24 can cover and be fixed in position to the first end of the hollow housing 22 to shield the wiping element 20. After the cleaning pen 2 is used for cleaning, the cap 24 can be put back on the hollow housing 22 to effectively isolate the wiping element 20 from the outside and prevent the wiping element 20 from soilage which may otherwise occur if the wiping element 20 is exposed to the dust and dirt in the environment. In consequence, not only is the service life of the wiping element 20 extended, but also the object to be cleaned by the wiping element 20 won't be scratched by the dust and dirt which may otherwise attach to the wiping element 20.

According to the above description, with reference to FIG. 2, the easily detachable and adjustable wiping element 20 enables the cleaning pen 2 of the present invention to feature a substantially extended service life, an enhanced cleaning effect, and a reduced risk of scratching the object being cleaned.

The embodiments described above are only the preferred embodiments and are not intended to limit the structural features of the present invention. All easily conceivable equivalent changes which are made to the foregoing embodiments by a person skilled in the art and which are based on the technical contents disclosed herein should fall within the scope of the present invention, which is defined only by the appended claims.

What is claimed is:

1. A cleaning pen, comprising:

a wiping element made of an absorbent material and coated with a wiping layer, wherein the absorbent material is a material capable of absorbing liquid, and the wiping layer is made of a fabric and serves to increase a structural strength of the wiping element as well as softness and fineness of a surface of the wiping element;

a hollow clamping device consisting of two clamping units, the two clamping units engageable to each other to form a single piece and define a clamping space therebetween, wherein the wiping element, when bent, can be fixedly clamped in the clamping space such that a bent portion of the wiping element juts out of the hollow clamping device; and a hollow housing having a first end formed with an opening, the opening having an inner diameter matching an outer diameter of the hollow clamping device, thus allowing the hollow clamping device to be inserted into the hollow housing through the opening and be secured in position in the hollow housing, the hollow housing having an inner wall protrudingly provided with at least a stop unit adjacent to the opening such that the hollow clamping device, when inserted in the hollow housing, is stopped at a predetermined position in the hollow housing while the bent portion of the wiping element juts out of the hollow housing.

2. The cleaning pen of claim 1, wherein the hollow housing has a second end provided with a receiving cavity for holding a cleaning liquid, and the cleaning pen further comprises a nozzle head, the nozzle head having a first end provided with a drawing unit and a side provided with a nozzle in communication with the drawing unit, the first end of the nozzle head covering and fixed in position to a cavity opening of the receiving cavity such that the drawing unit is received in the receiving cavity and ready for drawing the cleaning liquid, the cleaning liquid being drawn by the drawing unit and sprayed out through the nozzle when a second end of the nozzle head is pressed.

3. The cleaning pen of claim 1, wherein the hollow housing has a second end provided with a cleaning brush.

4. The cleaning pen of claim 1, further comprising a retracting seat, wherein the retracting seat has an end provided with a cleaning brush and is laterally provided with at least a projection, the retracting seat received in a receiving cavity at a second end of the hollow housing such that the at least a projection is respectively and movably received in at least a track laterally provided on a wall of the receiving cavity, the cleaning brush received in the receiving cavity when the retracting seat is moved inward of the receiving cavity, the cleaning brush jutting out of the second end of the hollow housing when the retracting seat is moved outward of the receiving cavity.

5. The cleaning pen of claim 2, wherein each said clamping unit has an inner wall protrudingly provided with at least an anti-slip rib.

6. The cleaning pen of claim 3, wherein each said clamping unit has an inner wall protrudingly provided with at least an anti-slip rib.

7. The cleaning pen of claim 4, wherein each said clamping unit has an inner wall protrudingly provided with at least an anti-slip rib.

8. The cleaning pen of claim 5, further comprising a cap for covering and being fixed in position to the first end of the hollow housing to shield the wiping element.

9. The cleaning pen of claim 6, further comprising a cap for covering and being fixed in position to the first end of the hollow housing to shield the wiping element.

10. The cleaning pen of claim 7, further comprising a cap for covering and being fixed in position to the first end of the hollow housing to shield the wiping element.

* * * * *